US009966180B2

(12) United States Patent
Schlieter et al.

(10) Patent No.: US 9,966,180 B2
(45) Date of Patent: May 8, 2018

(54) IMPEDANCE TRANSFORMER

(71) Applicant: Raytheon Company, Waltham, MA (US)

(72) Inventors: Daniel B. Schlieter, Richardson, TX (US); Patrick J. Kocurek, Allen, TX (US); Christopher A. Loehrlein, Murphy, TX (US); Brandon W. Pillans, Plano, TX (US)

(73) Assignee: Raytheon Company, Waltham, MA (US)

( * ) Notice: Subject to any disclaimer, the term of this patent is extended or adjusted under 35 U.S.C. 154(b) by 106 days.

(21) Appl. No.: 15/004,534

(22) Filed: Jan. 22, 2016

(65) Prior Publication Data

US 2017/0213634 A1 Jul. 27, 2017

(51) Int. Cl.

| | |
|---|---|
| ***H01P 5/02*** | (2006.01) |
| ***H01F 27/28*** | (2006.01) |
| ***H01F 41/04*** | (2006.01) |

(52) U.S. Cl.

CPC ..... *H01F 27/28* (2013.01); *H01F 41/04* (2013.01)

(58) Field of Classification Search

CPC ..... H01F 27/28; H01F 41/04
USPC ..... 333/34
See application file for complete search history.

(56) References Cited

U.S. PATENT DOCUMENTS

| | | | | |
|---|---|---|---|---|
| 2,761,141 A | | 8/1956 | Strandberg et al. | |
| 5,173,666 A | * | 12/1992 | Babbitt | H01P 5/08 333/33 |
| 6,737,932 B2 | * | 5/2004 | Killen | H01P 5/02 333/124 |
| 6,879,289 B2 | | 4/2005 | Hayes | |
| 7,262,673 B2 | | 8/2007 | Hesselbom | |
| 7,300,619 B2 | | 11/2007 | Napadensky et al. | |
| 7,388,279 B2 | | 6/2008 | Fjelstad et al. | |

(Continued)

FOREIGN PATENT DOCUMENTS

| | | |
|---|---|---|
| EP | 1410461 B1 | 8/2011 |
| GB | 767 067 A | 1/1957 |

(Continued)

OTHER PUBLICATIONS

International Search Report and Written Opinion of the International Searching Authority dated Feb. 6, 2017, for corresponding PCT Application No. PCT/US2016/063320.

(Continued)

*Primary Examiner* — Stephen E Jones
*Assistant Examiner* — Scott S Outten
(74) *Attorney, Agent, or Firm* — Renner, Otto, Boisselle & Sklar, LLP

(57) ABSTRACT

A transmission line impedance transformer including at least two different dielectric media having different dielectric properties, each of the dielectric media being configured to taper in thickness along the length of the impedance transformer in an inverse relationship with respect to each other so as to form a combined dielectric medium having an effective dielectric property that is graded along the transmission path. The two or more dielectric media may be disposed between two conductors to provide an impedance transformer in which a characteristic impedance of the transmission line varies along its length in response to the gradation of the effective dielectric property of the combined dielectric medium.

20 Claims, 2 Drawing Sheets

(56) References Cited

U.S. PATENT DOCUMENTS

| | | | |
|---|---|---|---|
| 7,973,391 | B2 | 7/2011 | Fjelstad et al. |
| 8,264,300 | B2 | 9/2012 | Cisco |
| 8,508,318 | B2 | 8/2013 | Iwanami |
| 2013/0170171 | A1 | 7/2013 | Wicker et al. |
| 2015/0044084 | A1 | 2/2015 | Hofmann et al. |

FOREIGN PATENT DOCUMENTS

| | | | |
|---|---|---|---|
| WO | 2012/128404 | A1 | 9/2012 |
| WO | 2015000057 | A1 | 1/2015 |

OTHER PUBLICATIONS

Yamasaki: "Scattering of electromagnetic waves by inhomogeneous dielectric gratings with parallel perfectly conducting strips-Matrix formulation of point matching method", Electromagnetic Theory (EMTS), Proceedings of 2013 URSI International Symposium on IEEE, May 20, 2013, pp. 767-770.

Dreher et al.: "Analysis of Microstrip Lines in Multilayer Structures of Arbitrarily Varying Thickness", IEEE Microwave and Guided Wave Letters, IEEE Inc., New York, U.S., vol. 10, No. 2, Feb. 1, 2000.

* cited by examiner

IMPEDANCE TRANSFORMER

FIELD OF INVENTION

The present invention relates generally to impedance transformers, and more particularly to additively manufactured impedance transformers having a graded dielectric property.

BACKGROUND

Electronic modules, such as radio frequency (RF) modules, typically contain RF circuits, transmission lines, high power amplifiers, and antenna elements that are commonly manufactured on specially designed substrate boards. For the purposes of such circuits, it is important to maintain control over impedance characteristics. If the impedance of different parts of the circuit do not match, this may result in inefficient power transfer, unnecessary heating of components, or various other problems. To minimize these problems, a transmission line impedance transformer matching network is commonly utilized in such circuits, for example, to match relatively low impedances at the gate and drain of field effect transistors (FETs) in the circuit with relatively high impedances needed in other parts of the circuit.

One factor affecting the performance of such transmission line impedance transformer matching networks is the dielectric property of the impedance transformer substrate medium, such as the dielectric constant of the medium. For example, the dielectric constant of the substrate medium affects the velocity of the signal propagating through the medium, and therefore the electrical length of the transmission line. In conventional RF design, an impedance transformer substrate medium is typically selected with a dielectric property value suitable for the design. Once the substrate material is selected, the transmission line characteristic impedance value may be exclusively adjusted by controlling the impedance transformer geometry and physical structure.

As the trend toward miniaturizing such RF modules and circuits continues, the ability to maintain the performance attributes of such circuits becomes increasingly difficult. For example, increasing the power and bandwidth of a high-power amplifier used in an RF circuit may be a common design criteria, but enhancing these attributes while maintaining a compact size of the circuit is difficult, if not often impractical. For example, while a transmission line transformer output matching network may be utilized to provide good bandwidth and excellent power output for the amplifier, such utilization is often at the expense of increased size and fabrication difficulty of the impedance transformer and circuit. As such, designers will typically be forced to trade one desired specification (e.g., power, bandwidth, size, or fabrication difficulty) so as to satisfy another one of these desired specifications.

SUMMARY OF INVENTION

The present invention provides an impedance transformer for a transmission line that has at least one gradually varied effective dielectric property along its length, which improves the overall performance of the transmission line, while also enhancing design flexibility and improving integration of such devices.

The exemplary impedance transformer may include a substrate having at least two different dielectric materials with different dielectric properties. Each of the dielectric materials may be configured to taper in thickness along the length of the impedance transformer in an inverse relationship to each other so as to provide an effective dielectric property that is graded along the length of the impedance transformer.

For example, a first dielectric medium and a second dielectric medium having different dielectric properties may each be configured as wedge-shaped members such that each medium has an inclined area and a tapered thickness. The wedge-shaped media may be disposed in an inverse relationship with respect to each other such that respective inclined areas interface with each other and the respective tapered thicknesses reduce in opposite directions. In this manner, the effective dielectric property of the combined dielectric medium may progressively increase or decrease corresponding with the relative change in thicknesses of the first dielectric medium (having a first dielectric property) and the second dielectric medium (having a second different dielectric property) along the length of the impedance transformer.

The dielectric property of each dielectric medium, or the effective dielectric property of the combined dielectric medium, may include one or more dielectric properties, such as permittivity (also referred to as relative permittivity, $\in_r$, or dielectric constant), permeability (also referred to as relative permeability or $\mu_r$), and conductivity (or its inverse, resistivity).

The two or more dielectric media may be disposed between two conductors to provide an impedance transformer in which a characteristic impedance of the transmission line varies along its length corresponding with the gradation of the effective dielectric property of the combined dielectric medium. In this manner, the exemplary impedance transformer may be used in a transmission line impedance transformer matching network to match the impedance characteristics from one circuit to another circuit.

Such an impedance transformer having a graded effective dielectric property or properties along its length enables a reduction in the number of discontinuities and abrupt changes in the transmission path between dielectric media, which may improve performance of the transmission line, and may also improve ease of manufacturing and associated costs. In addition, by reducing the number of interfaces or discontinuities along the transmission path, the reliability of the device may also improve since each interface is also a potential stress concentration during operation, which can lead to premature failure of the device during temperature cycling.

Such an impedance transformer used in a transmission line impedance matching network may also enable more efficient matching of the impedance characteristics of one circuit with another, while enabling higher power capabilities and increased bandwidth, and while also minimizing the size of such matching networks and signal loss.

To facilitate the manufacturing of such an impedance transformer, the two or more dielectric media may be formed by an additive manufacturing process, for example, layer-wise deposition or 3D printing. By additive manufacturing such impedance transformers, the fabrication of such media structures may be simplified with fewer steps. In addition, the tailorability and flexibility of the impedance transformer and corresponding circuit design may be improved. For example, such impedance transformers may be additively formed in situ within an RF module or directly integrated into circuits, and may be free-formed with circuitous paths around other circuit components, or may even be formed to extend vertically up RF module walls.

According to an aspect of the invention, an impedance transformer includes at least one dielectric medium configured such that the impedance transformer has at least one gradually varied effective dielectric property along its length.

According to another aspect of the invention, an impedance transformer includes a first dielectric medium having a first dielectric property, the first dielectric medium having a first inclined area to define a tapered thickness of the first dielectric medium that reduces in a first direction along a length of the impedance transformer; and a second dielectric medium having a second dielectric property different from the first dielectric property, the second dielectric medium having a second inclined area to define a tapered thickness of the second dielectric medium that reduces in a direction opposite the first direction along the length of the impedance transformer; where the second dielectric medium is disposed in an inverse relationship to the first dielectric medium such that the first inclined area interfaces with the second inclined area.

The impedance transformer may further include a first conductor and a second conductor, where the first dielectric medium and the second dielectric medium are disposed between the first conductor and the second conductor.

Embodiments of the invention may include one or more of the following additional features separately or in combination.

For example, the first dielectric medium may have a lower substrate surface extending along the length of the impedance transformer, the lower substrate surface being opposite the first inclined area and defining the tapered thickness of the first dielectric medium therebetween.

The second dielectric medium may have an upper substrate surface extending along the length of the impedance transformer, the upper substrate surface being opposite the second inclined area and defining the tapered thickness of the second dielectric medium therebetween.

The lower substrate surface and the upper substrate surface may be substantially planar surfaces.

The first conductor may be disposed on the lower substrate surface and the second conductor may be disposed on the upper substrate surface.

The lower substrate surface may be substantially parallel to the upper substrate surface.

The interface between the first dielectric medium and the second dielectric medium may be inclined with respect to a plane perpendicular to the lower and/or upper substrate surfaces.

The first dielectric medium and the second dielectric medium may have substantially the same width in a direction transverse to the first direction.

The respective widths of the first dielectric medium and the second dielectric medium may be substantially constant along the length of the impedance transformer.

The first dielectric medium and the second dielectric medium may be substantially wedge shaped.

The first dielectric medium and/or the second dielectric medium may have a maximum thickness at one end that is at least twice the minimum thickness at an opposite end.

The first dielectric property of the first dielectric medium may include a first dielectric constant, and the second dielectric property of the second dielectric medium may include a second dielectric constant.

The first dielectric constant may be at least five times greater than the second dielectric constant, or the second dielectric constant may be at least five times greater than the first dielectric constant.

At least one of the first dielectric medium and the second dielectric medium may have a graded effective dielectric property along its length.

The first dielectric medium and the second dielectric medium may define a combined dielectric medium, and the effective dielectric property of the combined dielectric medium may progressively increase or decrease along the length of the impedance transformer.

For example, the effective dielectric property of the combined dielectric medium may progressively increase or decrease in the first direction corresponding with the relative change in thicknesses of the first dielectric medium and the second dielectric medium along the length of the impedance transformer.

The impedance transformer may further comprises an input port for communicating with an input circuit having a first impedance characteristic, and an output port for communicating with an output circuit having a second different impedance characteristic.

The impedance transformer may have a characteristic impedance that is variable along its length so as to match the first impedance characteristic of the first circuit with the second impedance characteristic of the second circuit.

The variation in the characteristic impedance of the impedance transformer may at least partially correspond with the change in effective dielectric property of the combined dielectric medium along the length of the impedance transformer.

The impedance transformer may extend in a serpentine path.

The first dielectric medium and/or the second dielectric medium may be formed by an additive manufacturing process.

The first conductor and/or the second conductor may be formed by an additive manufacturing process.

The first dielectric medium and the second dielectric medium may be formed from a paste that is deposited by a layerwise additive manufacturing process.

According to another aspect of the invention, a method of manufacturing an impedance transformer includes: (i) forming a first dielectric medium from a first dielectric material having a first dielectric property, the first dielectric medium being formed to have a first inclined area and a tapered thickness that reduces in a first direction along a length of the impedance transformer; and (ii) forming a second dielectric medium from a second dielectric material having a second dielectric property different from the first dielectric property, the second dielectric medium being formed to have a second inclined area and a tapered thickness that reduces in a direction opposite the first direction along the length of the impedance transformer; where the second dielectric material is formed on the first dielectric medium in an inverse relationship to the first dielectric medium such that the first inclined area of the first dielectric medium interfaces with the second inclined area of the second dielectric medium.

The method of manufacturing an impedance transformer may include one or more of the following additional features separately or in combination.

For example, the method may further include: (i) forming a first conductor from a conductive material; and (ii) forming a second conductor from a conductive material; where the first dielectric medium and the second dielectric medium may be disposed between the first conductor and the second conductor.

Optionally, during the forming of the first dielectric medium and/or the second dielectric medium, the effective dielectric property of the first dielectric medium and/or the second dielectric medium may be graded along the length of the impedance transformer.

Alternatively or additionally, during the forming of the first conductor and/or the second conductor, the electrical conductivity of the first conductor and/or the second conductor may be graded along the length of the impedance transformer.

The method may further include solidifying at least one of the first conductor, the second conductor, the first dielectric medium, and the second dielectric medium after the respective forming steps.

The first conductor, the second conductor, the first dielectric medium, and the second dielectric medium may each be formed by deposition in a layerwise additive manufacturing process.

The first dielectric medium and the second dielectric medium may define a combined dielectric medium that is formed by depositing individual layers of dielectric material in a layerwise additive manufacturing process.

The first dielectric medium and the second dielectric medium may be deposited in a single extrusion step to define each individual layer.

The first dielectric medium and the second dielectric medium may each have an effective dielectric property that is graded along the length of the impedance transformer.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

A transmission line impedance transformer, such as for a transmission line impedance matching network, may include at least two different dielectric media having different dielectric properties, each of the dielectric media being configured to taper in thickness along the length of the impedance transformer in an inverse relationship with respect to each other so as to form a combined dielectric medium having an effective dielectric property that is graded along the transmission path. The two or more dielectric media may be disposed between two conductors to provide an impedance transformer in which a characteristic impedance of the transmission line varies along its length in response to the gradation of the effective dielectric property of the combined dielectric medium.

The principles of the present invention have particular application to RF circuits having microwave circuit impedance transformers or transmission lines, amplifiers and module interconnects/transistors, filters, power dividers and couplers, MMIC or ASIC circuits, etc., and thus will be described below chiefly in this context. It is understood that the impedance matching networks and techniques described herein are not limited to any particular type of RF circuit, or RF application. Rather, it is understood that principles of this invention may be applicable in a wide variety of radio frequency (RF) systems, circuits, and other devices where it is desirable to provide impedance matching between different parts of a circuit by using an impedance transformer that gradually varies a dielectric property so as to reduce abrupt discontinuities between the dielectric media, which may improve overall performance, design flexibility, and manufacturing costs, among other considerations. It should also be understood that the impedance transformer and related line matching techniques described herein are not limited to implementation on or with any particular type of RF transmission media and that the impedance transformer with a graded dielectric property or properties may be implemented in a variety of different RF transmission media including, but not limited to: microstrip, buried microstrip, stripline, twinline, slotline, co-planar waveguide, and suspended air stripline.

The term "dielectric property" as used herein refers to one or more of permittivity (also referred to as relative permittivity, $\in_r$, or dielectric constant), permeability (also referred to as relative permeability or $\mu_r$), and electrical conductivity (or electrical resistivity).

Figure 1:
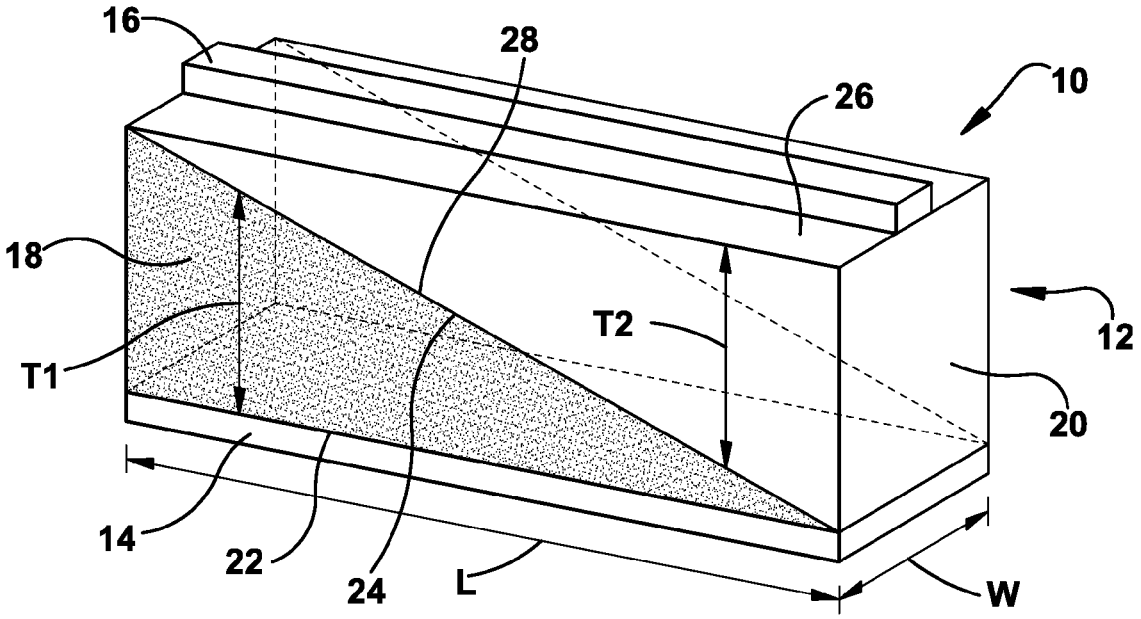
FIG. 1 is a perspective view of an exemplary impedance transformer according to the invention.

In the discussion above and to follow, the terms "upper", "lower", "top", "bottom," "end," "inner," "outer," "above," "below." etc. refer to the impedance transformer as viewed in a horizontal position, as shown in FIG. 1. This is done realizing that these devices, such as when used in electronic modules mounted to vehicles, can be mounted on the top, bottom, or sides of other components, or can be inclined with respect to the vehicle chassis, or can be provided in various other positions.

Turning now to FIG. 1, an exemplary impedance transformer 10 is shown. In the illustrated embodiment, the impedance transformer 10 is configured as a microstrip transmission line having a dielectric medium, or substrate, 12 disposed between two conductors 14, 16 on opposite sides. The first conductor 14 may be configured as a ground plane conductor and the second conductor 16 may be configured as a transmission line for propagating an electrical signal along the length (L) of the impedance transformer 10. The dielectric medium 12 may be configured as a combined dielectric medium having a first dielectric medium 18 and a second dielectric medium 20. The first dielectric medium 18 may have a first dielectric property (for example, a first dielectric constant), and the second dielectric medium 20 may have a second dielectric property (for example, a second dielectric constant) that is different from the first dielectric property.

As shown in the illustrated embodiment, the first dielectric medium 18 may have a lower (first) substrate surface 22 extending along the length (L) of the impedance transformer and an inclined area 24 that is opposite the lower substrate surface 22, which defines a tapered thickness (T1) of the first dielectric medium 18 therebetween. The second dielectric medium 20 may have an upper (second) substrate surface 26 extending along the length of the impedance transformer and an inclined area 28 that is opposite the upper substrate surface 26, which defines a tapered thickness (T2) of the second dielectric medium 20 therebetween. The second dielectric medium 20 may be disposed in an inverse relationship with respect to the first dielectric medium 18 such that the first inclined area 24 is adjacent to and interfaces with the second inclined area 28 and the respective tapered thicknesses T1, T2 progressively reduce in opposite directions.

By providing the at least two different dielectric media 18, 20 having different dielectric properties, a variable "effective" dielectric property of the combined medium 12 may be obtained. The effective dielectric property (for example, the effective dielectric constant, $\in_{eff}$) may be defined as the dielectric property that an electrical signal experiences when propagating along the transmission line 16 in the vicinity of the dielectric media 18, 20, which is at least partially dependent on the electromagnetic (EM) wave that exists in the respective dielectric media 18, 20. The effective dielectric property may be determined by the local overall thickness of the combined dielectric medium 12 and the local relative thickness of each medium 18, 20 along the transmission path, such that the resulting effective dielectric property obtains a value between the dielectric property value of each medium 18, 20.

So as to establish a communicating relationship of EM wave propagation between the two different dielectric media 18, 20, the first inclined area 24 may cooperate or couple in a complementary manner with the second inclined area 28 at the interface between media 18, 20. Generally, the interfacial area between the first dielectric medium 18 and the second dielectric medium 20 may be inclined with respect to a plane perpendicular to a longitudinal axis extending along the length of the impedance transformer. In this manner, the effective dielectric property of the combined dielectric medium 12 may gradually and uniformly increase (or decrease) corresponding with the relative change in thicknesses of the first dielectric medium 18 and the second different dielectric medium 20 along the length of the impedance transformer 10. For example, as the first dielectric medium 18 (having a first dielectric property, such as a first dielectric constant) progressively decreases in thickness along the length of the impedance transformer, and as the second dielectric medium (having a second different dielectric property, such as a second dielectric constant) progressively increases in thickness along the length of the impedance transformer 10, the effective dielectric property (for example, the effective dielectric constant) of the combined medium 12 may increase (or decrease) along the length of the impedance transformer 10, depending on the relative thicknesses of the dielectric media 18, 20, and whether the second dielectric property is greater (or less) than the first dielectric property.

For example, the effective dielectric property of the combined dielectric medium 12 may be graded by gradually increasing the effective dielectric constant of the combined dielectric medium 12 along the transmission path. For example, this may be achieved by providing the second dielectric medium 20 with a higher dielectric constant than the first dielectric medium 18. By gradually increasing the effective dielectric constant along the transmission path, the characteristic impedance of the transmission line may be gradually increased and the propagation velocity of the EM signal in the transmission line may be deliberately slowed, known as a slow-wave effect, which increases the electrical length per unit physical length and which may allow for circuit compaction.

In this manner, the variation in the characteristic impedance of the transmission line 16 may be at least partially determined by the gradation in the effective dielectric property (e.g., the effective dielectric constant) of the combined dielectric medium 12 along the length of the impedance transformer 10. This may enable the impedance transformer 10 to be usefully employed in a transmission line impedance matching system or network that is configured to match the impedance characteristic from one circuit to another circuit having a different impedance characteristics. As such, the impedance transformer 10 may include an input port (e.g., one end of the transmission line 16) for communicating with an input circuit having a first impedance characteristic, and an output port (e.g., an opposite end of the transmission line 16) for communicating with an output circuit having a second different impedance characteristic. The characteristic impedance of the transmission line 16 may be determined by a number of factors other than the effective dielectric property of the combined medium 12, including the width and thickness of the top conductor 16, and the spacing between the elongated conductors 14, 16, as well as other characteristics of the respective media 18, 20.

Generally, if a circuit has an exceptionally high or low impedance, it is usually difficult to create an impedance transformer that has the desired characteristic impedance for matching into the circuit, and that fits within the size limitations of the circuit. One known technique for impedance matching is to provide a single dielectric substrate (e.g., having a single dielectric constant) with a relatively long taper (i.e., Klopfenstein taper or stepped-impedance taper). However, such single-dielectric tapered impedance transformers are often impractically too narrow to achieve high impedance values, or are impractically too wide to achieve low impedance values. In addition, such single-dielectric tapered impedance transformers do not usually fit well onto a circuit, substrate, or MMIC having a limited aspect ratio (length-to-width ratio) or otherwise constrained real estate limitations.

Another known technique for impedance matching is to provide discrete cuboid segments of different dielectric media (having different dielectric constants) along the length of the transmission line, which connect at vertical interfaces perpendicular to the transmission path. However, such discrete cuboid segments do not gradually increase or decrease the effective dielectric property of the medium over the length of the transformer, and instead results in abrupt step-wise changes in the dielectric property from one material to another. These abrupt step-wise changes in the dielectric property (e.g., at the vertical interfaces) may adversely affect the performance characteristics of the device by causing undesirable scattering and reflections of the signal, which results in a net increase in transmission loss.

The exemplary impedance transformer described herein enables a wider range of impedance transformation that can be practically achieved (e.g., with practical widths) over a broader bandwidth and with higher power capabilities than would otherwise be possible with only a single tapered transformer section. More particularly, by providing the second dielectric medium 20 with a higher or lower dielectric property than the first dielectric medium 18, the effective dielectric property of the combined medium 12 may be increased or decreased over shorter distances than would otherwise be possible with a single dielectric material. For example, the exemplary impedance transformer may be capable of leveraging a relatively high dielectric constant of one of the dielectric media (e.g., the first dielectric medium) to achieve low impedances, and may be capable of leveraging a relatively low dielectric constant of another dielectric medium (e.g., the second dielectric medium) to achieve high impedances, while still providing a practical (e.g., manufacturable) size of the device. In addition, by interfacing the respective dielectric media 18, 20 in an inverse relationship with respect to each other such that the effective dielectric property is gradually changed over the length of the impedance transformer 10 allows for fewer and less abrupt discontinuities in the EM transmission path, which improves overall performance of the impedance matching network. Accordingly, a designer is provided with substantially greater flexibility with regard to the range of characteristic impedances that can be produced with the exemplary impedance transformer 10.

The exemplary impedance transformer 10 may also enable a wide range of characteristic impedances by controlling the dielectric properties of the respective dielectric media 18, 20 without the need for altering the overall thickness of the combined medium 12 along the transmission path, or without the need for changing the spacing between conductors 14, 16. For example, providing the first dielectric medium 18 with a lower dielectric constant compared to the second dielectric medium 20 can permit input of lines with lower impedance as compared to what could otherwise be achieved using a single conventional low dielectric substrate. In addition, by maintaining such planarity of the impedance transformer 10, the connections between circuits or other components may be improved without the need for specially designed interconnections.

The exemplary impedance transformer 10 may also enable transmission lines that are conventionally very wide to be reduced to a more manageable width for reducing the overall size of the impedance transformer and corresponding matching network. In other words, unlike conventional single substrate tapered line transformers, the exemplary impedance transformer 10 does not necessarily vary the line impedance by continuously increasing the transmission line width over the length of the transformer. Instead, the effective dielectric property of the combined medium 12 may be gradually varied over the length of the impedance transformer 10 so as to progressively change the characteristic impedance over the length of the transmission line 16. For example, selectively increasing the dielectric constant of the second dielectric medium 20 may permit higher impedance lines of practical width to be formed on the substrate when such high impedance values would otherwise be too narrow for practical implementation on a substrate.

So as to maintain planarity of the impedance transformer 10, the first dielectric medium 18 and the second dielectric medium 20 may each be configured as wedge-shaped members that are respectively configured to define a combined dielectric medium 12 having a rectangular parallelepiped structure. The lower substrate surface 22 of the first dielectric medium 18 and the upper substrate surface 26 of the second dielectric medium 20 may be substantially planar surfaces, which may be substantially parallel to each other on opposite sides of the combined dielectric medium 12. In the exemplary microstrip configuration, the first conductor 16 may be disposed on the lower substrate surface 22 and the second conductor 14 may be disposed on the upper substrate surface 26, each of which extend along the length (L) of the impedance transformer in the direction of the signal transmission path. In addition, the first dielectric medium 18 and the second dielectric medium 20 may have the same width (W), which may be substantially constant along the length of the impedance transformer 10.

In some non-limiting embodiments, the first dielectric medium 18 and the second dielectric medium 20 may each have a maximum thickness at one end in a range between 0.13 mm to 0.4 mm, and a minimum thickness at an opposite end in a range between 0.02 mm to 0.13 mm. In addition, the first dielectric medium 18 and the second dielectric medium 20 may each have a maximum width (W) in a range between 0.02 mm to 5 mm. The overall length (L) of the impedance transformer may be about 5 mm to 10 mm, or greater. The dielectric constant of the first dielectric medium may be in the range between about 1 to 10, and the dielectric constant of the second dielectric medium may be in the range between about 20 to 50. The exemplary impedance transformer may match an input impedance of about 5 ohm to an output impedance of about 50 ohm with 10:1 or greater bandwidth and having a signal loss of less than 1 dB at 200 W power output. The exemplary impedance transformer may have a minimal footprint, and may fit within an area of less than about 65 $cm^2$, preferably fitting within an area of only about 5 cm×5 cm.

Figure 2A:
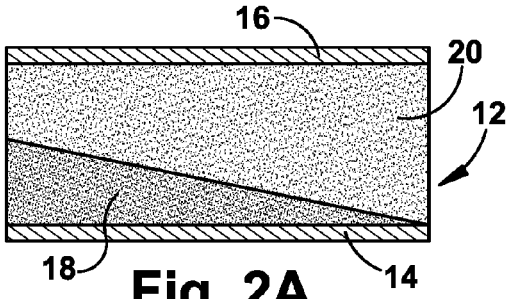
FIGS. 2A-2E are cross-sectional views of alternative embodiments of the exemplary impedance transformer.
Figure 2D:
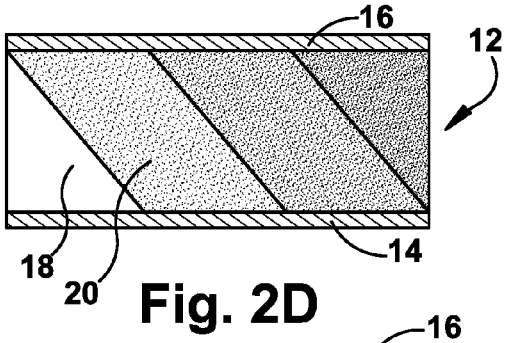
Figure 2B:
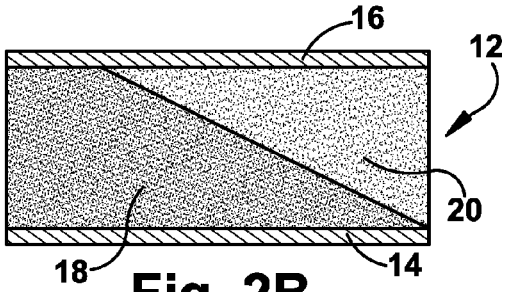
Figure 2E:
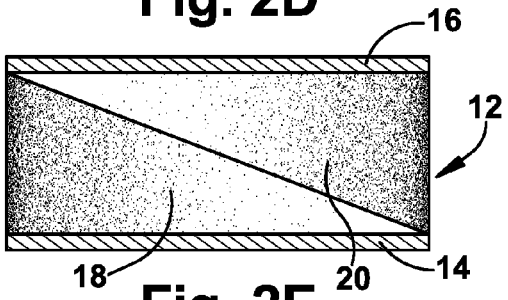
Figure 2C:
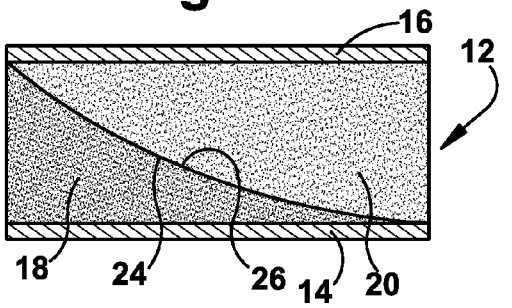

It is understood that other configurations of the exemplary impedance transformer 10 are possible. For example, although the inclined interfacial area between the first medium 18 and the second medium 20 may bisect the rectangular parallelepiped structure of the combined dielectric medium 12 (as shown in FIG. 1), it is also possible that the first dielectric medium 18 may constitute a larger or smaller segment of the combined dielectric medium 12 compared to that of the second dielectric medium 20 (as shown in FIGS. 2A and 2B, for example). It is also possible that the interfacial area between media 18, 20 may be curved, for example, the respective inclined areas 24, 28 may be configured as concave or convex areas (as shown in FIG. 2C, for example). In addition, it is understood that the first dielectric medium may instead increase in thickness along the transmission direction as the second dielectric medium inversely reduces in thickness. Also, the widths of the respective media 18, 20 and the overall thickness of the combined medium 12 may be held constant along the length of the impedance transformer 10, or the respective widths or overall thickness may be different or may vary along the length of the impedance transformer 10.

It is further understood that although the impedance transformer 10 may have only a single first dielectric medium 18 and a single second dielectric medium 20 that define the combined dielectric medium 12 and which constitute the entire length of the impedance transformer 10, it is also possible that more than two different dielectric media may be provided in the impedance transformer 10. For example: the first dielectric medium 18 and the second dielectric medium 20 may be provided as only one combined media section of a plurality of combined media sections along the length of the impedance transformer 10. The remaining plurality of media sections may repeat the pattern of the first medium 18 and second medium 20 along the remainder of the impedance transformer length, or the remaining sections may further vary the dielectric property (e.g., dielectric constant). Alternatively or additionally, the other media may have different dielectric properties from both the first medium 18 and second medium 20, for example: subsequent media may be disposed having progressively increasing dielectric constants along the impedance transformer length. The subsequent media may be interfaced and configured in a similar manner as the first medium 18 and second medium 20 to create a multiple-section, progressively increasing graded dielectric media along the length of the impedance transformer 10 (as shown in FIG. 2D, for example).

The foregoing approach of varying the effective dielectric property is not limited to use with microstrip constructions as shown in FIG. 1. Rather, these techniques may be used with any other line structure that is formed on a dielectric substrate, for example, buried microstrip, stripline, slotline and co-planar waveguide circuits where selected regions of the dielectric media above or below the transmission line have modified dielectric properties, as discussed above.

The dielectric materials for the media 18, 20 may be selected in a suitable manner depending on the effective dielectric property and impedance matching characteristics sought to be obtained. For example, through selection of suitable materials, the first dielectric medium may have a dielectric constant of about 1, and the second dielectric medium may have a dielectric constant of about 100, such that the effective dielectric constant of the combined medium 12 is about 1 at the first end, about 50 in the middle, and about 100 at the opposite end. Alternatively, the first dielectric medium may have a dielectric constant of about 100, and the second dielectric medium may have a dielectric constant of about 1, such that the effective dielectric constant of the combined medium 12 is about 100 at the first end, about 50 in the middle, and about 1 at the opposite end. Other combinations are possible, and the actual values and precise rate at which each of these dielectric characteristics can be varied over the length of the impedance transformer 10 will depend upon the particular design characteristics of the transformer and the range of impedance characteristics sought to be obtained.

In the illustrated embodiment of FIG. 1, the dielectric property of each dielectric medium 18, 20 may be substantially uniform throughout each medium segment. However, as shown in illustrated embodiment of FIG. 2E, it is also possible that the effective dielectric property of each individual medium 18, 20 may be continuously varied or graded (increasing or decreasing) across the medium, for example, along the length of the impedance transformer in the direction of the transmission path. For example, the effective dielectric constant of the first medium 18 may be continuously graded such that the dielectric constant value is about 1 toward the thicker end, about 25 toward the middle, and about 50 toward the tapered end. The effective dielectric constant of the second medium 20 may also be continuously graded such that the dielectric constant value is about 10 toward the tapered end, about 50 toward the middle, and about 100 toward the thicker end. Other combinations are possible, and the actual values and precise rate at which each of these effective dielectric properties for each individual medium may be varied will depend upon the desired design characteristics of the impedance transformer.

The choice of a dielectric composition can provide effective dielectric constants that gradually increase or decrease over a range from less than 2 to about 2500. The dielectric materials can be prepared by mixing with other materials, such as thermosets, thermoplastic, or other binding media; or by including varying densities of voided regions (which generally introduce air), all of which may produce the desired dielectric constants, as well as other potentially desired media properties.

For example, materials exhibiting a low dielectric constant (<2 to about 9) may include silica and/or alumina with varying densities of voided regions. While neither silica nor alumina have any significant magnetic permeability, magnetic particles may be added to render these or any other material significantly magnetic, which may generally increase the permittivity of the media layer.

Materials exhibiting a medium dielectric constant are generally in the range of about 70 to 500. As noted above, these materials may be mixed with other materials or voids to provide a desired dielectric constant. These materials can include ferrite doped calcium titanate. Doping metals can include magnesium, strontium and niobium. These materials have a range of 45 to 600 in relative magnetic permeability.

For high value dielectric constants, ferrite or niobium doped calcium or barium titanate zirconates may be used. These materials have a dielectric constant of about 2200 to 2650. Doping percentages for these materials are generally from about 1 to 10 volume percent. As noted above with respect to other materials, these materials may be mixed with other materials or voids to provide the desired effective dielectric constant.

Figure 3:
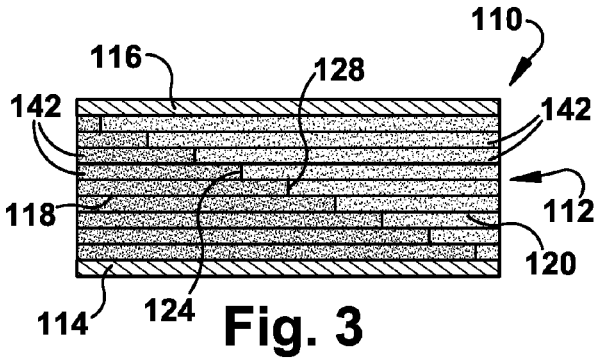
FIG. 3 is a cross-sectional view of another exemplary impedance transformer formed by a layerwise additive manufacturing press.

To facilitate the fabrication of the exemplary impedance transformer, the dielectric media and/or the conductors may be formed by an additive manufacturing process. Referring to FIG. 3, an exemplary embodiment of an impedance transformer 110 that is formed by an additive manufacturing process is shown. The impedance transformer 110 is substantially the same as the above-referenced impedance transformer 10, and consequently the same reference numerals but indexed by 100 are used to denote structures corresponding to the same or similar structures in the impedance transformer. In addition, the foregoing description of the impedance transformer 10 is equally applicable to the impedance transformer 110, except as noted below.

In the illustrated embodiment, the impedance transformer 110 includes a combined dielectric medium layer 112 disposed between two conductors 114, 116 on opposite sides. The dielectric medium 112 includes a first dielectric medium 118 having a first dielectric property (e.g., a first dielectric constant), and a second dielectric medium 120 having a second different dielectric property (e.g., a second dielectric constant). The first dielectric medium 118 has an inclined area 124 and a tapered thickness, and the second dielectric medium 120 has an inclined area 128 and a tapered thickness. The second dielectric medium 120 is disposed in an inverse relationship with respect to the first dielectric medium 118, such that the first inclined area 124 interfaces in a communicating relationship with the second inclined area 128 and the respective tapered thicknesses of the media 118, 120 progressively reduce in opposite directions.

In some embodiments, the combined dielectric medium 112, or the individual dielectric media 118, 120, may be formed with a dielectric material that may be deposited through a nozzle by way of a layerwise additive manufacturing process, such as micro-dispense. For example, the dielectric material may be a dielectric paste that may be deposited as a series of single layers 142, or traces, as the nozzle moves across the build area. In this manner, the individual media 118, 120, may be formed layer by layer until reaching a desired shape or configuration. The term "layer" as used herein means one or more levels, or of potentially patterned strata, and not necessarily a continuous phase.

In some embodiments, each of the respective layers 142 of the first dielectric medium 118 may be deposited to fully form the first dielectric medium 118 before the layers of the second dielectric medium 120 are deposited and formed. Optionally, the dielectric paste may be solidified before subsequent layers 142 are deposited, or after the entire first dielectric medium 118 structure is formed. The dielectric paste may be solidified by such methods including temperature treatment, air drying, UV curing, or other suitable methods of solidification well-known in the art. In other embodiments, a layer 142 of the first dielectric medium material may be deposited, followed by an adjacent layer 142 of second dielectric medium material. As each subsequent layer of the first material is deposited on top of the lower layer, the length of the first dielectric material layer may decrease; and as each subsequent layer of the second material is deposited on top of the lower layer and adjacent to the first dielectric material, the length of second dielectric material layer may increase in such a way as to provide an inverse relationship between the respective media 118, 120, (as shown in FIG. 2, for example). Optionally, the dielectric paste may be solidified (such as through temperature treatment, air drying, UV curing, or other suitable methods) before subsequent layers 142 are deposited on top of each other, or after the entire combined media 112 structure is formed.

The conductors 114, 116 may likewise be additively manufactured in a similar manner. For example, the first conductor 114 may be deposited with an electrically conductive paste, and the dielectric layers 142 of the first medium 118 and the second medium 120 may be subsequently deposited on top of the first conductor 114. The second conductor 116 may be deposited with an electrically conductive paste on top of the dielectric media layers 142. Optionally, the electrically conductive paste may be solidified, such as through temperature treatment or air drying, before subsequent layers 142 are deposited. The foregoing approach of additive manufacturing is not limited to microstrip constructions, and may be used with other line structures, such as buried microstrip, stripline, coplanar waveguide, slotline, etc.

Depending at least in part on the shape of the orifice in the nozzle through which the material is extruded, the extruded dielectric and/or conductive paste may in some embodiments have a substantially square or cylindrical shape. Because the extruded and deposited paste may undergo a settling process, or in some cases a solidification process (for example, air-drying or thermal treatment, such as sintering or curing) after being deposited in the one or more layers 142, the shape of the layers 142 and the overall shape of the impedance transformer 110, including the respective media 118, 120 and/or conductors 114, 116, may include some distortions. As such, the first medium 118 and the second medium 120 may be described as having substantially planar and parallel surfaces, substantially constant widths, substantially wedge-shaped forms, etc., which is defined herein as having those shapes or forms, or those distorted shapes or forms. In addition, due at least in part to the shape of the extruded paste, settling, or the nature of the layerwise additive manufacturing process, the respective inclined areas 124, 128 of the dielectric media 118, 120 may depart from a perfectly sloped surface, and may instead include some distortions or minor ridges that are about the thickness of the deposited layer (as shown in FIG. 3, for example). As such, the inclined areas 124, 128 as defined herein may be effectively inclined to a plane perpendicular to the a longitudinal axis extending along the length of the impedance transformer 110 and may include such distortions or minor ridges.

Due to the desired functionality of the dielectric media 118, 120, the dielectric material may be selected in a suitable manner to provide a desired dielectric property (e.g., a desired dielectric constant) or other characteristics. The dielectric materials may typically exhibit good electrical insulation, for example, on the order of about $10^{-4}$ to $10^{-8}$ siemens per meter. The electrically conductive material for forming the conductors 114, 116 may also be selected in a suitable manner to have a desired conductivity, or other characteristic. For example, the conductors 114, 116 may have an electrical conductivity on the order of about $10^{4}$ to $10^{7}$ siemens per meter. The respective pastes may include a polymeric binder, such as a flowable thermoset or thermoplastic, that includes a mixture of one or more dielectric, magnetic, or conductive materials dispersed therein.

The dielectric paste and/or the electrically conductive paste may be designed with an appropriate chemistry and viscosity to enable extrusion through the nozzle and to provide the desired structures of the media 118, 120 and/or the conductors 114, 116. Preferably, the respective pastes have thixotropic shear thinning behavior that enable the pastes to be extruded through the nozzle and yet be able to retain a self-supported shape of the deposited layer 142 after exiting the nozzle. In addition, it may be preferable that the respective pastes have good chemical compatibility and good wetting behavior with respect to each other, and with respect to other circuit components, so as to form strong interfacial bonds in the as-deposited state, as well as after any post-processing, such as thermal treatment, without compromising the structural integrity of the respective structures.

One advantage to additively manufacturing the impedance transformer 110 by way of layerwise deposition is that the impedance transformer structures may be fabricated in situ, directly within an RF module or directly integrated with the impedance matching network, and therefore may not necessarily require subtractive machining or etching, nor prefabrication and subsequent integration steps. In addition, the impedance transformer 110 may be "free-formed" in straight, circuitous, or serpentine paths, for example, around other circuit components, or even up vertical walls, which greatly enhances the tailorability and flexibility of the impedance transformer and/or RF module design.

It is understood that the additive manufacturing process for forming the impedance transformer 110 is not limited to layerwise deposition, and may include other methods, such as, but not limited to: Selective Laser Sintering (SLS), Stereolithography (SLA), micro-stereolithography, Laminated Object Manufacturing (LOM). Fused Deposition Modeling (FDM), MultiJet Modeling (MJM), aerosol jet, direct-write, inkjet fabrication, and micro-dispense. Areas of overlap can exist between many of these methods, which can be chosen as needed based on the materials, tolerances, size, quantity, accuracy, cost structure, critical dimensions, and other parameters defined by the requirements of the object or objects to be made.

In addition, certain additive manufacturing processes, such as micro-dispense or fused-filament fabrication, may be adapted to continuously vary or uniformly grade the effective dielectric property of each individual medium 118, 120, or the combined dielectric medium 112, along the impedance transformer 110 in the direction of the transmission path. Such an exemplary process may be used to create such impedance transformers as the exemplary impedance transformer shown in FIG. 2D. For example, an additive manufacturing extrusion printhead may be adapted to actively mix blends of two or more dielectric materials that are fed into the extrusion head. The composition of the blended material to be deposited may be varied by varying the ratios of the respective materials, which may be dependent on the feed rates of the respective materials into the printhead, among other factors. In this manner, the blend composition may be actively varied during deposition to create a dielectric media with a continuously changing or graded dielectric property. Other electrical or dielectric properties of the individual dielectric media 118, 120 may be altered in similar manner, such as the permittivity, permeability, and electrical conductivity. The electrical properties of the conductors 114, 116 may also be varied in a similar manner, for example, to adjust the electrical resistivity of the transmission line so as to vary the characteristic impedance of the transmission line along its length. By continuously varying the dielectric and/or electrical properties of the dielectric media and/or the conductors through additive manufacturing in this way greatly improves the design flexibility and performance characteristics of the exemplary impedance transformer.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An impedance transformer comprising:

a first conductor and a second conductor;

a first dielectric medium having a first material composition that exhibits a first dielectric property, the first dielectric medium having a first inclined area to define a tapered thickness of the first dielectric medium that reduces in a first direction along a length of the impedance transformer; and a second dielectric medium having a second material composition that exhibits a second dielectric property that is different from the first dielectric property, the second dielectric medium having a second inclined area to define a tapered thickness of the second dielectric medium that reduces in a direction opposite the first direction along the length of the impedance transformer;

wherein the first dielectric medium and the second dielectric medium are disposed between the first conductor and the second conductor;

wherein the second dielectric medium is disposed in an inverse relationship to the first dielectric medium such that the first inclined area interfaces with the second inclined area; and wherein at least one of the first material composition of the first dielectric medium and the second material composition of the second dielectric medium is configured to vary in the first direction to provide a graded dielectric property of the first dielectric medium and/or the second dielectric medium along the first direction.

2. The impedance transformer according to claim 1, wherein the first dielectric medium has a lower substrate surface extending along the length of the impedance transformer, the lower substrate surface being opposite the first inclined area and defining the tapered thickness of the first dielectric medium therebetween; and wherein the second dielectric medium has an upper substrate surface extending along the length of the impedance transformer, the upper substrate surface being opposite the second inclined area and defining the tapered thickness of the second dielectric medium therebetween.

3. The impedance transformer according to claim 2, wherein the lower substrate surface and the upper substrate surface are substantially planar surfaces; and wherein the first conductor is disposed on the lower substrate surface and the second conductor is disposed on the upper substrate surface.

4. The impedance transformer according to claim 2, wherein the lower substrate surface is substantially parallel to the upper substrate surface, and wherein the interface between the first dielectric medium and the second dielectric medium is inclined with respect to a plane perpendicular to the lower and/or upper substrate surfaces.

5. The impedance transformer according to claim 1, wherein the first material composition and/or the second material composition is configured to vary by changing an amount of dielectric constituent material contained in the first dielectric medium and/or the second dielectric medium.

6. The impedance transformer according to claim 5, wherein the amount of dielectric constituent material continuously increases or decreases in the first direction to provide a corresponding increase or decrease in the graded dielectric property.

7. The impedance transformer according to claim 5, wherein the dielectric constituent material includes one or more of: silica, alumina, ferrite-doped calcium titanate, magnesium, strontium, niobium, ferrite-doped calcium titanate zirconate, ferrite-doped barium titanate zirconate, niobium-doped calcium titanate zirconate, and niobium-doped barium titanate zirconate.

8. The impedance transformer according to claim 1, wherein the first dielectric medium and the second dielectric medium define a combined dielectric medium, and wherein the effective dielectric property of the combined dielectric medium progressively increases or decreases in the first direction corresponding with the relative change in thicknesses of the first dielectric medium and the second dielectric medium along the length of the impedance transformer.

9. The impedance transformer according to claim 8, wherein the impedance transformer further comprises an input port for communicating with an input circuit having a first impedance characteristic, and an output port for communicating with an output circuit having a second different impedance characteristic; and wherein a characteristic impedance of the impedance transformer is variable along its length so as to match the first impedance characteristic of the first circuit with the second impedance characteristic of the second circuit, the variation in the characteristic impedance at least partially corresponding with the change in effective dielectric property of the combined dielectric medium along the length of the impedance transformer.

10. The impedance transformer according to claim 1, wherein the first dielectric medium and the second dielectric medium have substantially the same width in a direction transverse to the first direction, wherein the respective widths of the first dielectric medium and the second dielectric medium are substantially constant along the length of the impedance transformer; and wherein the first dielectric medium and/or the second dielectric medium have a maximum thickness at one end that is at least twice the minimum thickness at an opposite end.

11. The impedance transformer according to claim 1, wherein each of the first dielectric medium and the second dielectric medium are discrete wedge shaped solid materials.

12. The impedance transformer according to claim 1, wherein the first dielectric property of the first dielectric medium includes a first dielectric constant, and the second dielectric property of the second dielectric medium includes a second dielectric constant, wherein the first dielectric constant is at least five times greater than the second dielectric constant, or wherein the second dielectric constant is at least five times greater than the first dielectric constant.

13. The impedance transformer according to claim 1, wherein the first material composition of the first dielectric medium and the second material composition of the second dielectric medium both vary in the first direction to provide a continuously graded effective dielectric property from one end of the impedance transformer to an opposite end of the impedance transformer.

14. The impedance transformer according to claim 1, wherein the first dielectric medium and the second dielectric medium together comprise a plurality of bonded layers of solidified paste that define a combined dielectric medium.

15. The impedance transformer according to claim 1, wherein the interface between the first dielectric medium and the second dielectric medium is curved.

16. The impedance transformer according to claim 1, wherein the first dielectric medium and the second dielectric medium together define a single combined dielectric medium having an effective dielectric property, the effective dielectric property of the combined dielectric medium being configured to progressively increase or decrease in the first direction by varying both the first material composition and the second material composition along the first direction of the impedance transformer.

17. A method of manufacturing an impedance transformer comprising:

providing a first conductor and a second conductor;

forming a first dielectric medium from a first material composition exhibiting a first dielectric property, the first dielectric medium being formed to have a tapered thickness that reduces in a first direction along a length of the impedance transformer;

forming a second dielectric medium from a second material composition exhibiting a second dielectric property different from the first dielectric property, the second dielectric medium being formed to have a tapered thickness that reduces in a direction opposite the first direction along the length of the impedance transformer; and disposing the first dielectric medium and the second dielectric medium in an inverse relationship with respect to each other between the first and second conductors;

wherein the forming the first dielectric medium and/or the second dielectric medium includes varying the respective first and/or second material compositions along a length of the respective first and/or second dielectric media to provide a graded dielectric property along said first and/or second dielectric media length.

18. The method according to claim 17, wherein at least the first dielectric medium and the second dielectric medium are formed by deposition in a layerwise additive manufacturing process; and the method further comprising: solidifying at least the first dielectric medium and the second dielectric medium.

19. The method according to claim 18, wherein the first dielectric medium and the second dielectric medium define a single combined dielectric medium that is formed by depositing individual layers of dielectric material during the layerwise additive manufacturing process, wherein the first dielectric medium and the second dielectric medium are deposited successively in a single extrusion step to define each individual layer, and wherein, during the deposition of each individual layer, the first material composition of the first dielectric medium and the second material composition of the second dielectric medium are varied to provide a continuously graded effective dielectric property from one end of the impedance transformer to an opposite end of the impedance transformer.

20. The method according to claim 17, wherein, during the respective forming steps, the first material composition and the second material composition are both varied to provide a continuously graded effective dielectric property from one end of the impedance transformer to an opposite end of the impedance transformer.

* * * * *